US007725060B2

(12) United States Patent
Leemhuis et al.

(10) Patent No.: US 7,725,060 B2
(45) Date of Patent: May 25, 2010

(54) SKIRT FOR TONER CARTRIDGE

(75) Inventors: Michael Craig Leemhuis, Nicholasville, KY (US); Christian Blair Miller, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 281 days.

(21) Appl. No.: 11/928,871

(22) Filed: Oct. 30, 2007

(65) Prior Publication Data

US 2009/0110439 A1 Apr. 30, 2009

(51) Int. Cl.
*G03G 15/08* (2006.01)

(52) U.S. Cl. ..... 399/262; 399/256

(58) Field of Classification Search ..... 222/DIG. 1; 399/254, 255, 256, 258, 262, 263
See application file for complete search history.

(56) References Cited

U.S. PATENT DOCUMENTS

| | | | | |
|---|---|---|---|---|
| 6,169,860 | B1 | 1/2001 | Curry et al. | |
| 6,459,876 | B1 | 10/2002 | Buchanan et al. | |
| 6,510,303 | B2 | 1/2003 | Bessette | |
| 6,526,245 | B1 * | 2/2003 | Yamashita | 399/254 |

* cited by examiner

*Primary Examiner*—Hoang Ngo
(74) *Attorney, Agent, or Firm*—James E. Cole; John Victor Pezdek

(57) ABSTRACT

A skirt for a toner cartridge comprises a body having a pair of parallel edges, a plurality of beams extending along the body in the direction of the pair of parallel edges, the beams having a first end dimension B, the beams having a second end dimension b, the plurality of beams having tapered edges between the first end and the second end defining a ratio R defined by dimensions b/B being from about 0 to 0.9 for inhibiting creep deflection.

14 Claims, 11 Drawing Sheets

SKIRT FOR TONER CARTRIDGE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a skirt for a toner cartridge, and more specifically relates to a skirt having a preselected geometry for use with a toner cartridge in order to inhibit creep and promote efficient movement of toner within an electrophotographic (laser) printer.

2. Description of the Related Art

Laser printers utilize a light beam which is focused to expose a discreet portion of an image transfer drum in a further attempt to attract printing toner to these discreet portions. Toner comprises a mixture of pigment, typically carbon black, and plastic. When the toner becomes electrostatically charged, the toner is attracted to exposed portions of the image transfer drum. When a medium, printing paper, passes over the rotating transfer drum, the toner is transferred to the medium. Afterward, the medium passes through a heat fuser so that the plastic is melted and permanently fused with the medium.

Existing laser printers utilize replaceable toner cartridges having a developer roll, a toner reservoir and a metering system. Within the toner cartridge a skirt is connected to a rotating shaft in order to define a paddle which moves the toner through one or more reservoir areas and toward the image transfer drum. The skirt sweeps and/or flicks toner from one portion of the cartridge to a second portion of the cartridge. After repeated operations, the toner becomes depleted due to the printing process.

There are generally three factors that influence a skirt's ability to transport toner: length, geometry and thickness. In order to work properly, the skirt must engage portions of the toner cartridge housing and must deflect to some extent for best moving the toner. However, one problem encountered during shipping of toner cartridges occurs when the cartridges are subjected to elevated temperatures of greater than 100 degrees Fahrenheit. When the skirt is subjected to such temperatures and deflected due to engagement with some portion of the toner cartridge housing, the deflection combined with the high temperatures can result in a permanently deflected skirt, which is typically referred to as "creep" of the material. A skirt which has been affected by creep is less effective in moving toner as it provides less interference with the housing and thus is limited in the amount of toner which can be transferred toward a desired location in the toner cartridge. When the skirt fails to provide an adequate amount of toner, then starvation occurs resulting in an incomplete print image or an image which is lighter than desired.

Software solutions have been implemented to position the skirt at a location with decreased or no contact with the toner cartridge when the cartridge is shipped or between operating cycles. However, such solution resulted in a decrease in throughput of media since the skirt was repositioned between each media page printed. With the detrimental effect to printing functionality, a mechanical solution was desirable.

It would be desirable if a skirt design limited or eliminated creep associated with toner cartridge paddles.

SUMMARY OF THE INVENTION

A skirt for a toner cartridge comprises a body having a pair of parallel edges, a plurality of beams extending along the body in the direction of the pair of parallel edges, the beams having a first end dimension B, the beams having a second end dimension b, the plurality of beams having tapered edges between the first end and the second end defining a ratio R defined by dimensions b/B being from about 0 to 0.9 for inhibiting creep deflection. The skirt further comprises a plurality of mounting apertures. The skirt further at least one of the plurality of mounting apertures being disposed between each of the beams. The body has a thickness of about 0.1 millimeter. The body has a thickness of about 0.2 millimeters. The body is formed of polyethylene terephthalate polyester (PET). The ratio R is about 0.27.

A paddle assembly for urging toner to a location within a toner cartridge, comprises a rotatable shaft, a skirt connected to the rotatable shaft, the skirt having a plurality of sides including an upper skirt edge and a lower skirt edge, a plurality of beams extending generally in the direction between the upper skirt edge and the lower skirt edge, the beams having a base portion adjacent the upper skirt edge with a dimension B and a tip portion adjacent the lower skirt edge with a dimension b, the beams being tapered from the tip portion to the base portion defining a ratio R of b to B of less than or equal to about 0.9 for inhibiting creep deflection. The beams are tapered with the ratio R being about 0.27. The paddle assembly further comprises a plurality of fasteners extending from the shaft through the skirt. The beams have a wider dimension at an upper area and a narrower dimension at a lower area. The lower edge of the skirt is an interference edge for engaging an inner surface of a toner cartridge. The paddle assembly further comprises an opening between the plurality of beams. The upper edge is disposed above the opening and the lower edge is disposed below the opening. The paddle assembly wherein the plurality of tapered beams define sides of the opening. The skirt further comprises a thickness of about 0.125 millimeters. The skirt further comprising a thickness of about 0.188 millimeters. The skirt has a thickness of between about 0.1 and 0.2 millimeters.

A skirt for a toner paddle comprises a body having an upper edge and a lower edge, a plurality of windows disposed between the upper edge and the lower edge of the body, the windows defined by tapered beams, the beams having a wider end near the upper edge and a narrower end near the lower end, the tapered beams being tapered having a ratio R of b/B of between about 0 to 0.9 to inhibit creep deflection.

BRIEF DESCRIPTION OF THE DRAWINGS

The aforementioned features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
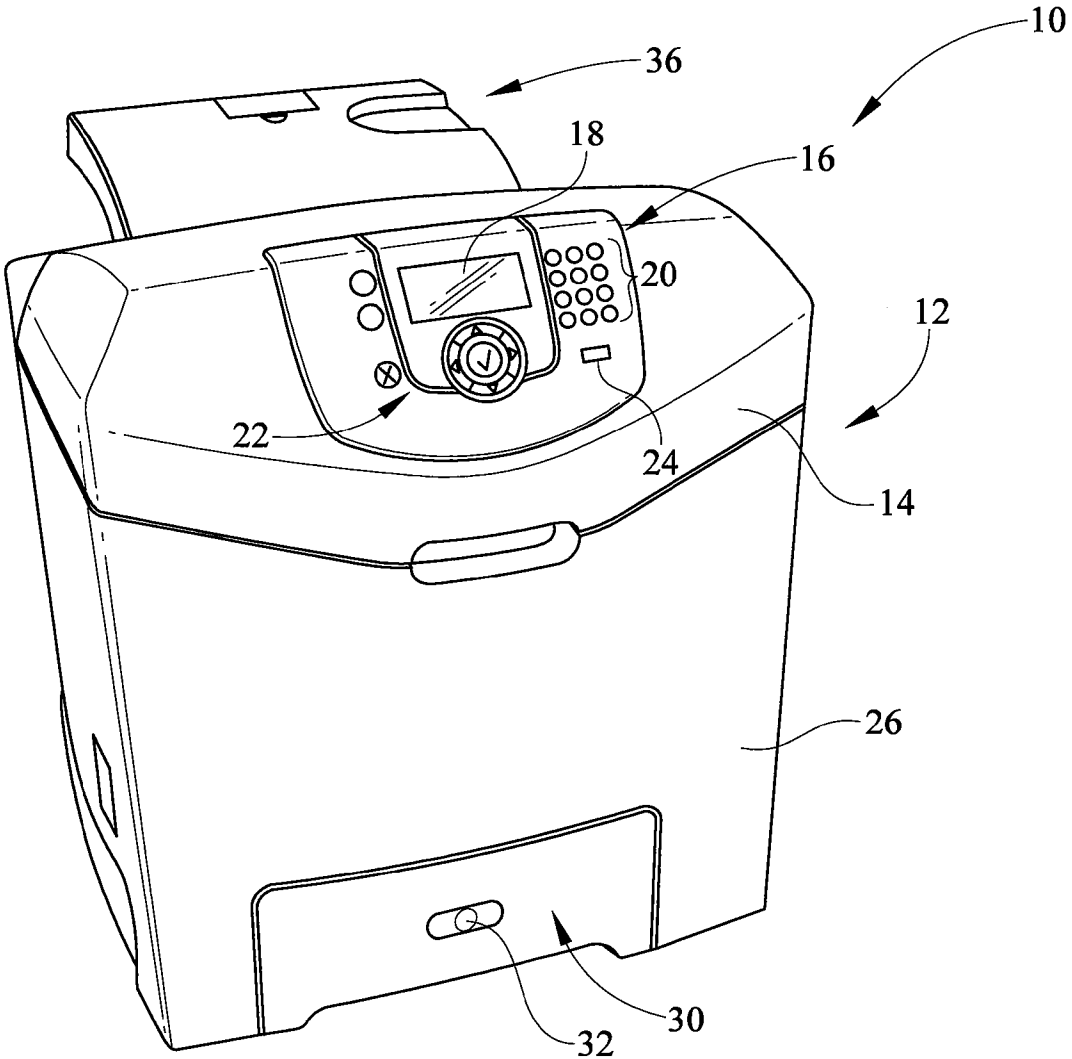
FIG. 1 depicts a peripheral device having a laser print engine in perspective view.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate two or more functions such as scanning, copying, printing, and faxing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term media and paper may be used interchangeably herein and may include plain paper, glossy photo paper, coated paper, card stock, index cards, labels, envelopes, transparency, MYLAR, fabric, or other printable materials. The term print engine, as used herein, means the at least one media feed assembly but may also include the carrier assembly and the base tray component in combination. The term operations panel, as used herein, means an interactive display allowing for menu display, menu selections, image viewing, editing of images, correction of error conditions and other operations and control functions. The term peripheral may include a single function or multi-function, or all-in-one, device which may be connected to a host computer, network connected or may be a stand-alone, which is a device which may function independently of any host computer.

Figure 2:
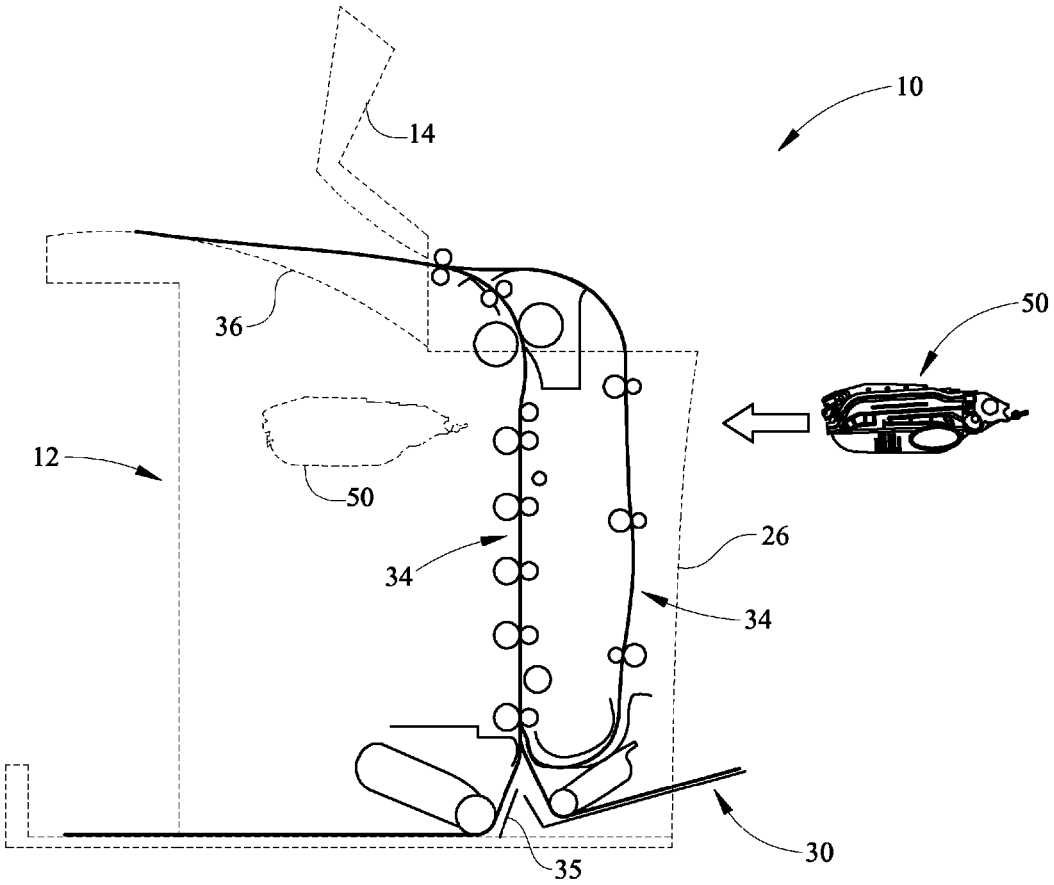
FIG. 2 depicts a side-sectional view of the exemplary peripheral of FIG. 1.

The exemplary embodiments described herein provide a skirt for a toner cartridge which inhibits creep deflection during shipping and non-operational times and when engaging the toner cartridge and exposed to elevated temperatures. Referring now to FIG. 1, a perspective view of a laser printer 10 is depicted in perspective view. Although, the peripheral device is depicted, one skilled in the art should realize that the present design may alternatively be used with an all-in-one device, copier, tax, stand-along device or the like having an electrophotographic (laser) print engine. The laser printer 10 comprising a housing 12 including a primary toner access door 14 positioned on the front of the housing 12. The housing 12 generally comprises a front surface, first and second side surfaces, a rear surface (not shown) and a bottom surface to enclose the laser printer operating mechanisms. On the front of the housing 12, the toner access door 14 is pivotally mounted to allow opening and access for installation or removal of a toner cartridge 50 (FIG. 2). The front panel of the primary access door 14 comprises a control panel 16 which includes a display 18, an alpha numeric keypad 20, a plurality of selection buttons 22, as well as a flash memory slot 24. The control panel 16 is in electronic communication with a controller (not shown), which may be embodied by one or more micro-processors, in order to operate the laser printer 10. Beneath the primary access door 14 is a secondary access door 26 which allows access to additional toner cartridges, such as in the case where the laser printer is printing in both monochrome and color. For example, three additional toner cartridges may be utilized to provide the color printing comprising the toner colors cyan, yellow or magenta, although others colors may be utilized.

Beneath the access doors 14, 26 is an input tray access door 30. When the input tray access door 30 is opened with a release 32, an input tray 35 is accessible to load the printer 10 with media. The input tray may hold a stack of media for use with the laser printer 10 and further defines a starting point of a media feedpath 34 (FIG. 2) extending from the media input tray to a media output tray 36. The media feedpath 34 may be a duplex feedpath, as depicted, or a simplex feedpath. The media output tray 36 is located on top of the housing 12 and generally extends rearwardly to store printed media processed by the laser printer 10.

Referring now to FIG. 2, the laser printer 10 is shown in side-section view. The primary toner access door 14 is raised and the secondary toner cartridge access door 26 is opened allowing positioning of a toner cartridge 50 within the housing 12. The toner cartridge 50 is shown in solid line for positioning within the printer 10. The cartridge 50 is also shown in broken line within printer 10 in broken line adjacent the feedpath 34. Also, as shown in FIG. 2, the feedpath 34 is depicted extending between the input tray 35 and the output tray 36.

Figure 3:
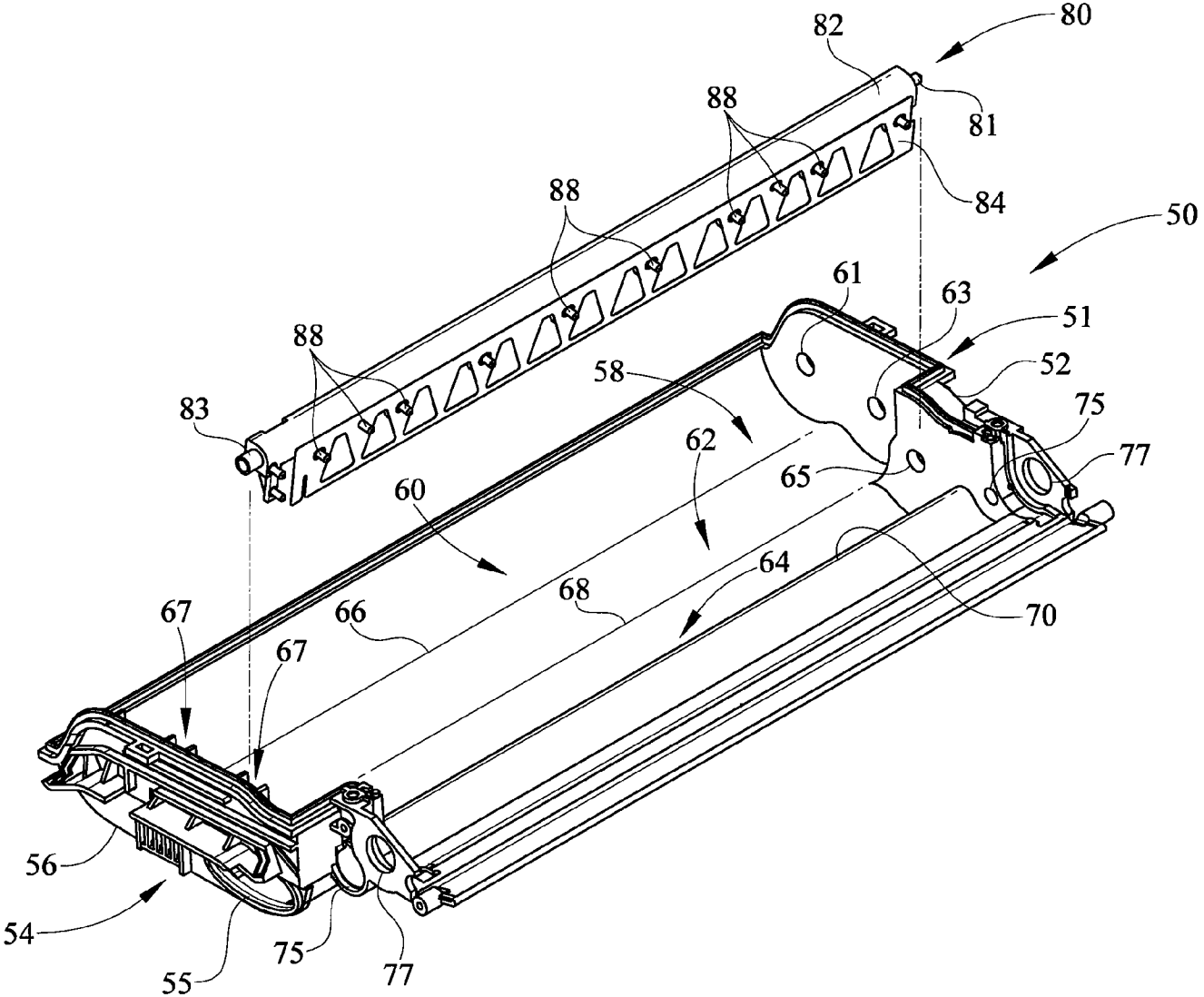
FIG. 3 depicts a perspective view of an exemplary toner cartridge.

Referring now to FIG. 3, a perspective view of the toner cartridge 50 is depicted in perspective view. The toner cartridge 50 is depicted with an upper portion or lid removed so that to depict an interior of the cartridge 50 and a paddle 80 exploded from the cartridge 50. Although a single paddle 80 is depicted for purpose of clarity, multiple paddles may be used corresponding to the member of toner sumps within the cartridge 50. The toner cartridge 50 comprises a housing 51 having a first wall 52 and an opposed second wall 54 with a lower support surface or floor 56 extending between the first side wall 52 and the second side wall 54. The first and second side walls 52, 54 and the floor 56 define, in part, a toner reservoir 58 having a first toner sump 60, a second toner sump 62 and a third toner sump 64. The sumps 60, 62, 64 are storage areas or compartments within the cartridge 50 where toner (not shown) is positioned for printing with the laser printer 10. Although three toner sumps 60, 62, 64 are depicted in the exemplary embodiment, one skilled in the art should realize that reservoirs of various size and shape and well as varying numbers of toner sumps may be utilized. According to the exemplary toner cartridge 50 depicted, three toner paddles 80 are utilized, one for each sump 62, 64, 66 in order to move toner from the first sump 60 to the third sump 64 and on to a toner adder roller (not shown) and further on to a developer roller (not shown) until the toner is deposited on an imaging drum (not shown).

The floor 56 further comprises at least one interference feature to aid movement of toner. Located in between the first toner sump 60 and the second toner sump 62 is an interference feature 66 which provides a surface against which the paddle 80 may create a force to move toner. Engagement of the paddle 80 and the interference feature 66 aids with movement of the toner from the first sump 60 to the second sump 62. A second interference feature 68 is also positioned between the second toner sump 62 and the third toner sump 64. Interference features 66, 68 aid the rotating paddles in moving toner from sump to sump for subsequent movement to a toner adder roller and developer roller.

Depicted along the first sidewall 52 are paddle journal apertures 61, 63 and 65. Each of the journal apertures 61, 63, 65 provides a pivoting location for a paddle 80 positioned within the toner cartridge 50. The paddles 80 are driven to rotate by a transmission (not shown), such as gear transmission, located on the outward side of the first sidewall 52. Opposite each of the journal apertures 61, 63, 65 are a plurality of keyways 67 (FIG. 4) which receives the opposite end of paddles 80. Thus two opposed positions are created for receiving each paddle 80 and allowing for pivotal motion of each paddle 80 in order to move toner in reservoir 58 from a first end to a second end of cartridge 50.

Moving from the paddle journal aperture 65, in a direction opposite from the first toner sump 60 of the journal aperture 61, a hump 70 extends from the floor 56. The hump 70 is larger than the interference features 66, 68. The hump 70 has a height which is greater than the interference features 66, 68. This causes increased interference engagement with the skirt 84 and further results in toner being flung into the air and on to a toner adder roll. Moving further from the journal aperture 65 opposite hump 70 are apertures 75 on the first and second sidewalls 52, 54 and an area for receiving a toner adder roller. The toner adder roller (not show) is a foam roller which receives toner from flung upwardly by the engagement between skirt 84 and hump 70. The toner adder roller must be thoroughly coated with toner therefore the hump 70 and skirt 84 fling toner upwardly to provide better coating on the toner adder roller. The toner adder roller engages a developer roller (not shown) to transfer toner from the toner adder roller. The developer roller is housed between journal apertures 77 to rotate within the cartridge 50.

Exploded from the toner cartridge 50 is the paddle 80. A single paddle 80 is depicted for clarity however one skilled in the art should realize that multiple paddles may be utilized or alternatively a single paddle may be utilized based on the configuration of toner sumps within the cartridge 50. The paddle 80 comprises a shaft 82 having a first end 81 and a second end 83. The first end 81 is positioned within the one of the apertures of first wall 52. On the opposite side of the first sidewall 52, the gear transmission, as previously described, is operably engaging the shaft 82 to rotate the paddle 80. The shaft 82 is depicted as obloid shaped however various shapes may be utilized. Connected to the shaft 82 is an attachable skirt 84 which engages the floor 56 and hump 70 to fling toner in the air to properly coat the toner adder roller. The shaft 82 includes a plurality of fasteners 88 extending through mounting apertures 87 in the skirt 84. The fasteners 88 may be a plurality of meltable structures which are melted and flattened during manufacture to form a head outside of the shaft 82 and to retain the skirt 84 on the shaft 82. However, alternative fasteners may be utilized such as rivets, screws, or the like.

Within the second sidewall 54, a toner fill aperture 55 is disposed in order to allow filling of the toner cartridge 50 during manufacture. The aperture 55 is oblong in shape in order to allow faster filling of toner, although various shapes may be utilized. A plug (not shown) covers the aperture 55 once the toner cartridge 50 is filled.

Figure 4:
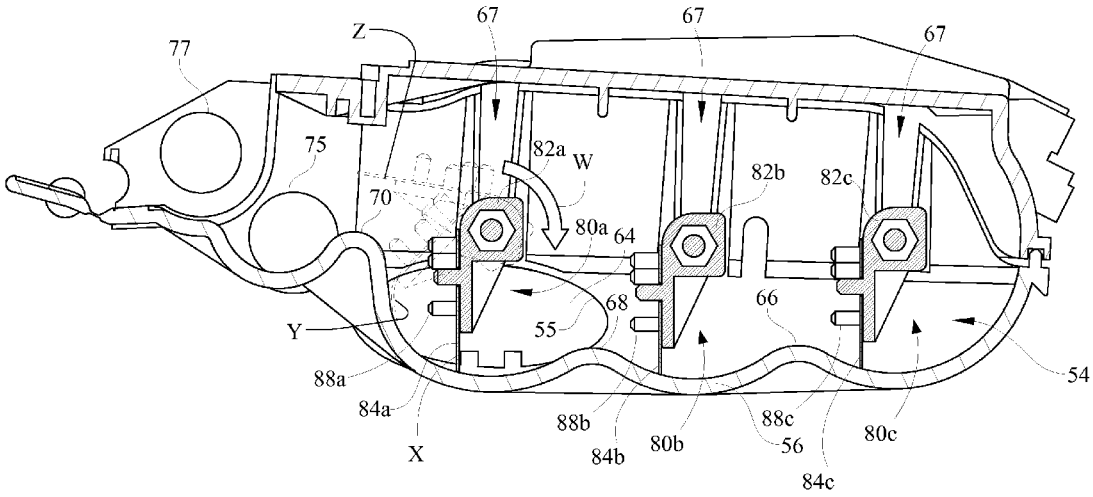
FIG. 4 depicts a side-sectional view of the toner cartridge of FIG. 3.

Referring now to FIG. 4, a side section view of the toner cartridge 50 is shown. Specifically, the inside of the second sidewall 54 is depicted as well as the floor 56 and the first and second interference features 66, 68. Located within the forwardmost, middle and rearmost keyways 67 are paddles 80*a*, 80*b*, and 80*c* having skirts 84*a*, 84*b*, and 84*c* extending from shafts 82*a*, 82*b*, 82*c*, respectively. Operation of paddle 80*a* in forwardmost keyway 67 in third toner sump 64 will be described. The fasteners 88*a*, 88*b*, and 88*c* for skirts 84*a*, 84*b*, and 84*c*, respectively, are depicted in an unflattened state, however, as previously described, such fasteners are melted and flattened during manufacture of the present invention. The skirt 84*a* extends from the shaft 82*a* and engages the third toner sump 64 at position X. As seen in FIG. 4, the radius of the third toner sump 64 varies as the floor 56 moves upwardly into the hump 70. Due to the dimension of the skirt 84*a* extending from the shaft 82*a* and the varying radius of hump 70, the skirt 84*a* flexes as the paddle 80*a* rotates in the clockwise direction. The flexing of the skirt 82*a* causes the storage of energy which is required to fling the toner located in the third toner sump 64. At position Y, the flexing of the skirt 84*a* is depicted in broken line with the paddle 80*a* rotated in the direction indicated by arrow W. As the paddle 80*a* rotates further to a third position at Z which is depicted in broken line, the paddle 80*a* is again shown with skirt 84*a* in an unflexed position. In this position the energy stored within the skirt 84*a* has been released so that the toner is flung into the air. The amount of toner flung, the height and distance are all dependent upon the amount of energy stored in the skirt 84*a* during engagement of the paddle 80*a* and hump 70 while in operation. Other relevant factors in the calculus of insuring proper toner coverage of the toner adder roll (not shown) include, but are not limited to, thickness of the skirt 84*a* and geometry of beams located within the skirt 84*a*. As seen in the figure, the hump 70 extends higher than the interference features 66, 68. This provides that the skirt 84*a* remains flexed for a longer period of time and flexed a greater distance than skirts 84*b*, 84*c*. With skirt 84*a* flexed for a longer period of time and distance, stored energy in skirt 84*a* is released and the toner is flung when skirt 84*a* is at a higher position causing more upward direction of motion for the toner and better coverage of the toner on the toner adder roll.

Figure 5:
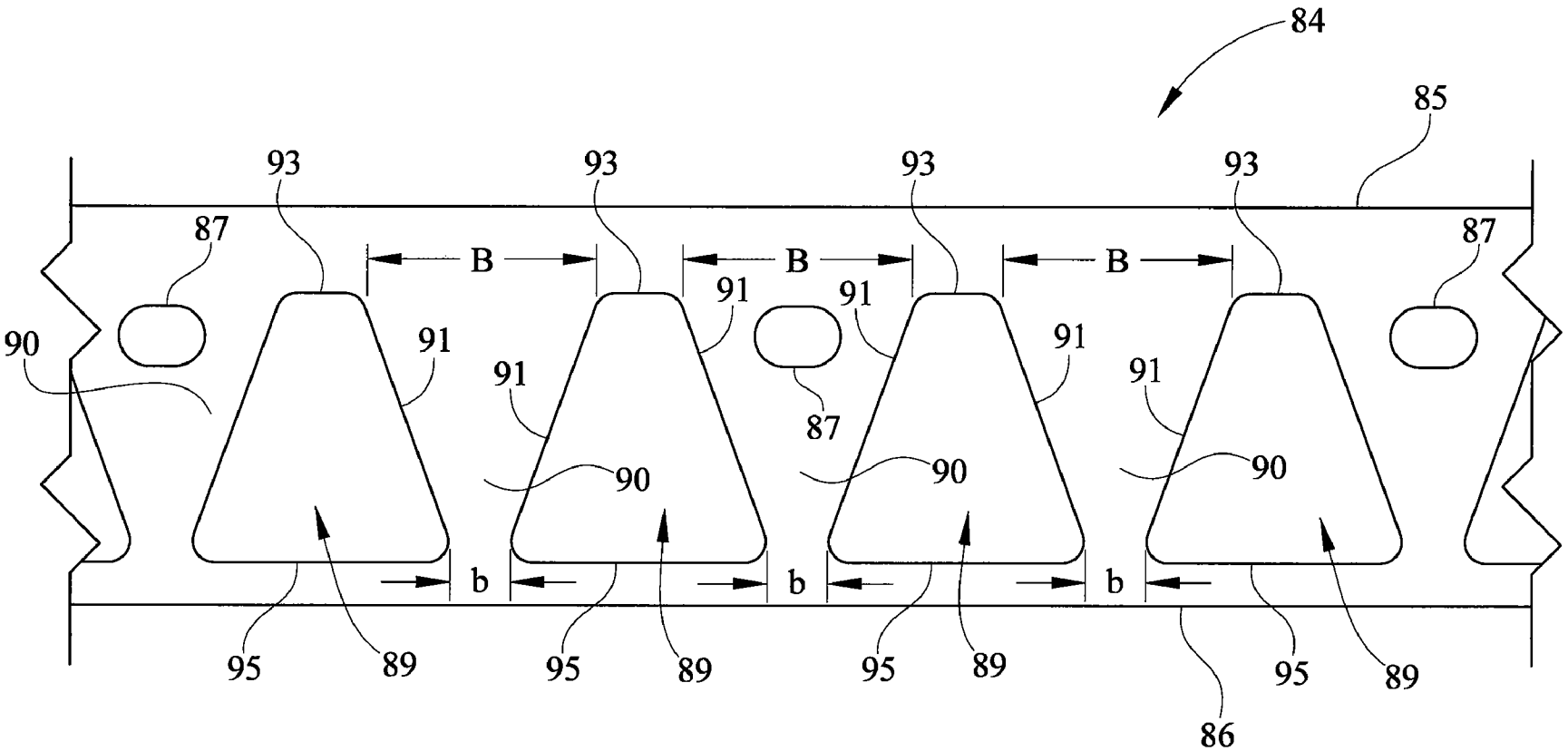
FIG. 5 depicts a front view of an exemplary skirt.

Referring now to FIG. 5, skirt 84 is shown in front view. The exemplary skirt 84 is formed of polyethylene terephthalate polyester (PET), having the trade name MYLAR, although other materials may be utilized. The polyethylene terephthalate polyester (PET) is somewhat flexible yet firm enough to urge movement of toner within the cartridge 50 as the paddle 80 rotates. The skirt 84 has an upper edge 85 and a continuous lower edge 86 with a plurality of spaced apart tapered beams 90 extending between and connected to both the upper edge 85 and a continuous lower edge 86. The skirt 84 also comprises first and second ends having parallel edges and corresponding to adjacent first and second sidewalls 52, 54 of toner cartridge 50 (FIG. 3). A plurality of openings or windows 89 are disposed between the upper edge 85 and the lower edge 86. Disposed between selected windows 89 are fastener openings or mounting apertures 87 which allow the fasteners 88 to pass through allowing for connection of the skirt 84 to the shaft 82. Each of the windows 89 are separated by a beam 90. The windows 89 are quadrilateral in shape however other shapes may be used which incorporate the beam taper angles described. The beams 90 include tapered edges 91 providing the angled sides of the windows 89. The beams 90 taper from a wider portion "B" at an upper edge 93 of the skirt window 89 to a narrower portion "b" toward the bottom edge 95 of the skirt window 89. The measurement "B" is a width between windows 89 at adjacent the upper edge 85 of the beam 90 while the measurement "b" is a width between windows 89 adjacent the lower edge 86 of the beam 90. Tapered beams 90, with a B greater than b, inhibit the phenomenon known as creep deflection in the skirt 84. During shipping of the toner cartridges, printers and also during times when the printer is stopped, the skirt 84 may be positioned wherein the skirt 84 is resting on the hump 70 or otherwise engaging the cartridge 50 causing deflection of the skirt 84. With prior art skirts, when a skirt came to rest against such a feature, high heat conditions, to which the cartridge may be exposed, for example during shipping, resulted in creep deflection of the skirt. At high temperatures and extended periods of time, prior art skirts may creep to a permanently deformed state which fail to properly engage the cartridge and fail to move toner efficiently and effectively during subsequent operation. The present skirt 84 includes tapered beam members 90 disposed between and defining the windows 89. The greater the taper of the beams 90, inhibits creep by decreasing beam stiffness, reducing internal stress, and therefore promotes improved performance of the skirt 84.

As measured from the horizontal, defined along the lower edge 86 of the skirt 84, the tapered beam/window edge 91 may be between about 45 degrees and 80 degrees.

Figure 6:
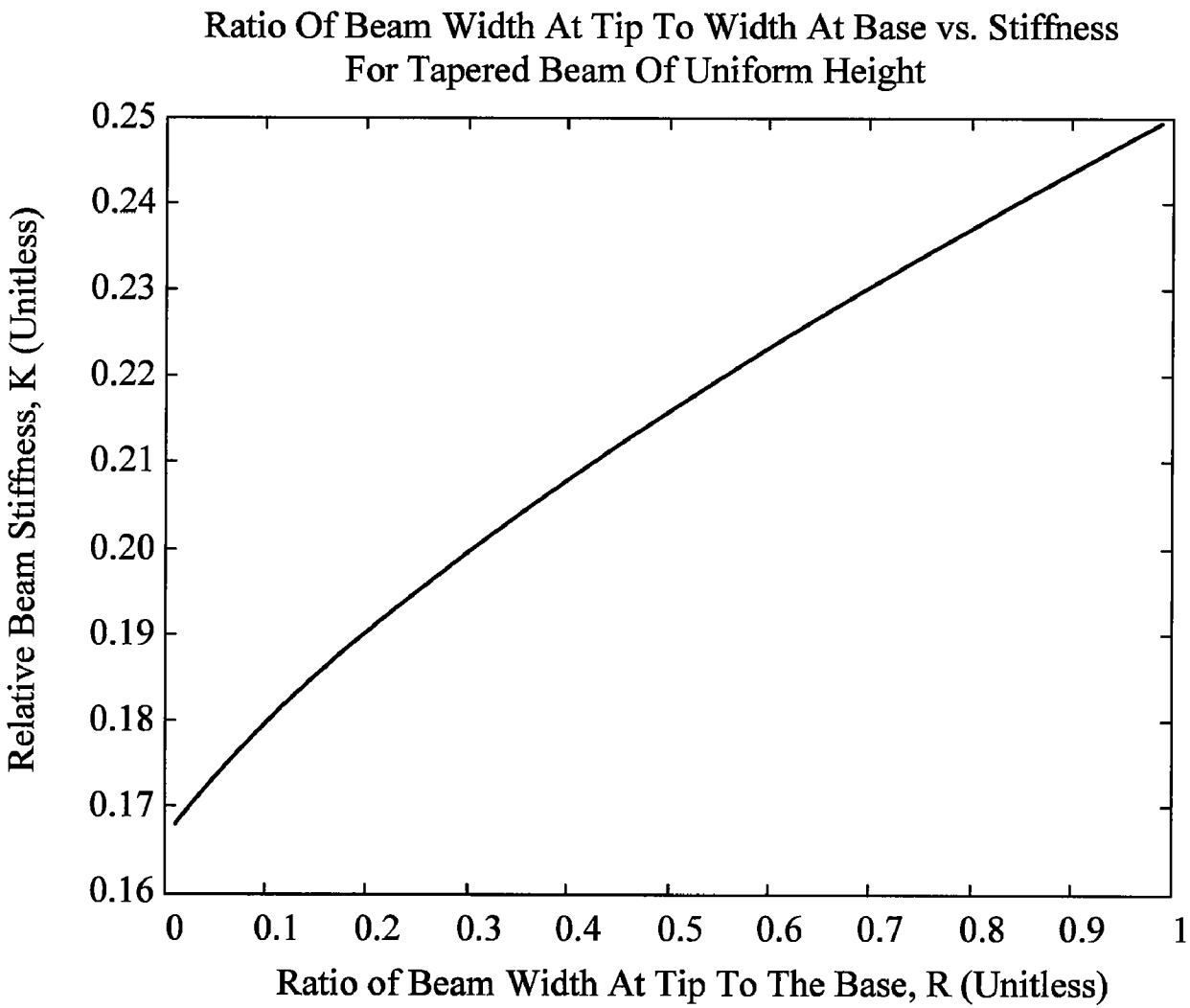
FIG. 6 depicts a graph beam width ratios to beam stiffness for optimization.

Referring now to FIG. 6, a graph is depicted relating beam width ratios between the width near the tip "b" and the width near the base "B". The ratio is plotted versus relative beam stiffness. The stiffness is calculated by first calculating beam deflection for a tapered beam of rectangular cross-section utilizing the following equation:

Beam Deflection (Maximum) For A Tapered Beam of Rectangular Cross Sections, $Y$, $Y=12P/(EF^2)\{C^2/F \log[(C+FL)/C]+L/2(FL-2C)\}$ Where:

$C=Rh^3$ $F=(1-R)h^3/L$

Ratio Of Large Base B To Tip Base b, $R=b/B$

Height of Rectangular Section (Constant), h

Length of Beam (Constant), L

Force Applied to Beam (Constant), P

Deflection of Beam, Y

Beam Stiffness Equation: $K=P/Y$

Where:

Stiffness of Beam, K

Next the beam deflection is utilized to calculate the relative beam stiffness charted in FIG. 6. In order to minimize the bending stress developed in the cantilever beam 90, the stiffness must be minimized. For example, if two beams of equal length, one of which is stiffer than the other, are deflected an equal amount the stiffer beam will be more likely to fail as the stress to create its deflection is higher. Any given material has a certain stress limit at which it plastically deforms, and then later a stress at which it fails completely. Therefore, reading the chart in FIG. 6, the best possible tapered beam configuration is one in which the beam width at the tip is 0. Visually, this would represent a triangular beam, with a taper angled such that the tip of the beam is a point. It is considered desirable to have a beam with characteristics of least stiffness, left most portion of the curve, minimizing K while supporting the interference edge with a manufacturable amount of plastic. Another consideration is to maintain the ability to move enough toner to adequately coat a toner adder roll. If the tip dimension "b" is too small, the possibility arises that there may not be enough surface area to move a sufficient amount of toner with the skirt 84. After testing, the ratio R defined by b/B was found to be suitable between the values of about 0 and 0.9. The ratio R was found to be optimal around 0.27 and provided a relative beam stiffness of about 0.198.

Figure 7:
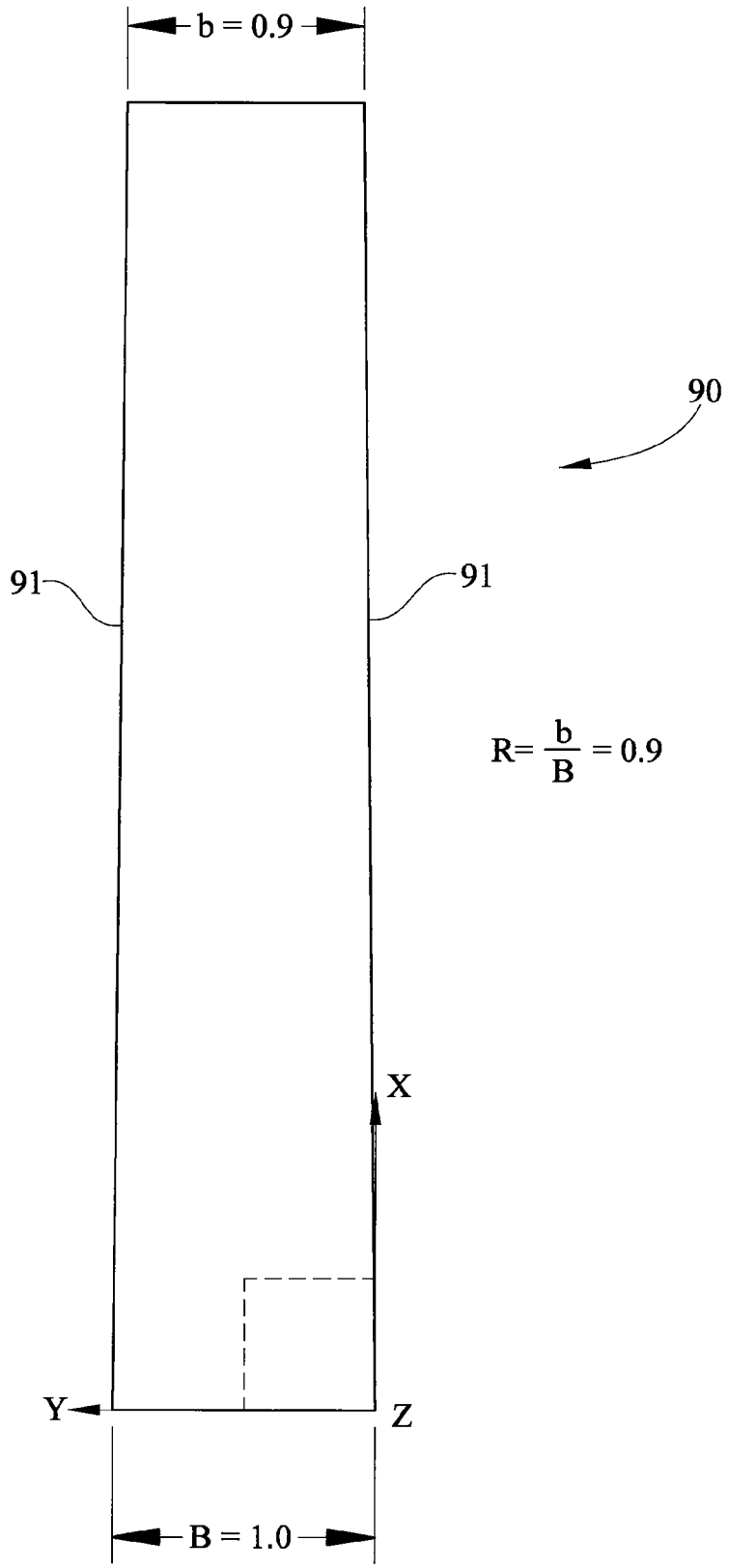
FIG. 7 depicts a front view of a representative beam having a first ratio.

Referring now to FIG. 7, an exemplary beam 90 is depicted in front view corresponding to the position of the beam 90 in FIG. 5. The beam 90 includes tapered edge 91 defining sides of the windows 89 (FIG. 5). The tapered edges 91 extend between a base portion having a dimension labeled "B" and a tip portion having a dimension labeled "b". The base portion, tip portion and tapered edges define the four sides of the beam 90. The corresponding dimensions depicted in the illustrative figure are B=1 and b=0.9. These dimension provide the ratio R of b/B equal to 0.9.

Figure 8:
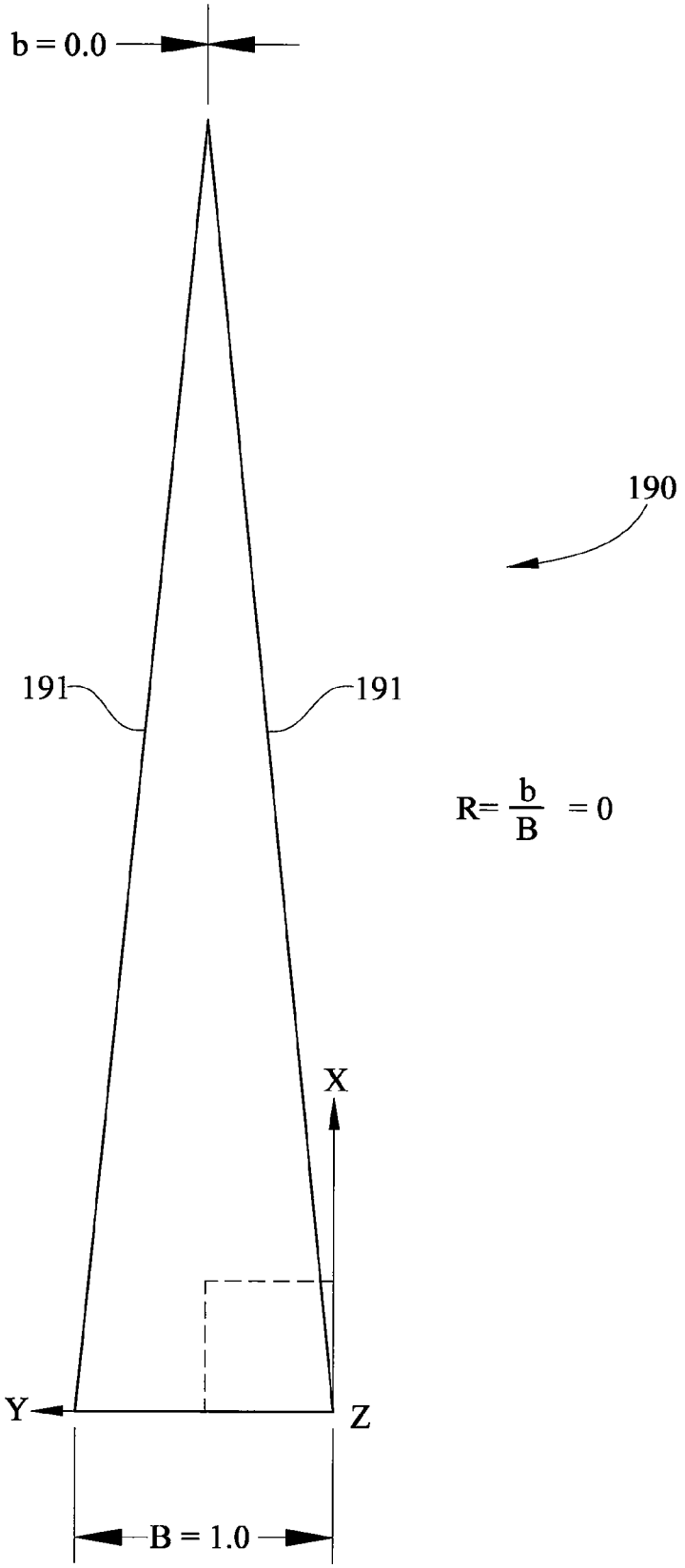
FIG. 8 depicts a front view of a representative beam having an alternative ratio.

Referring now to FIG. 8, an alternative beam 190 is depicted in front view also corresponding to a position of the beam 90 in FIG. 5. The beam 190 also includes a base portion B with a dimension equal to 1 unit. The tip portion b has a dimension equal to zero (0). Accordingly, the beam 190 is depicted as triangular in shape. Tapered beam edges 191 extend between the base portion B and the tip portion b. According to the beam shape depicted in FIG. 8, the ratio R of b/B is equal to zero (0).

Figure 9:
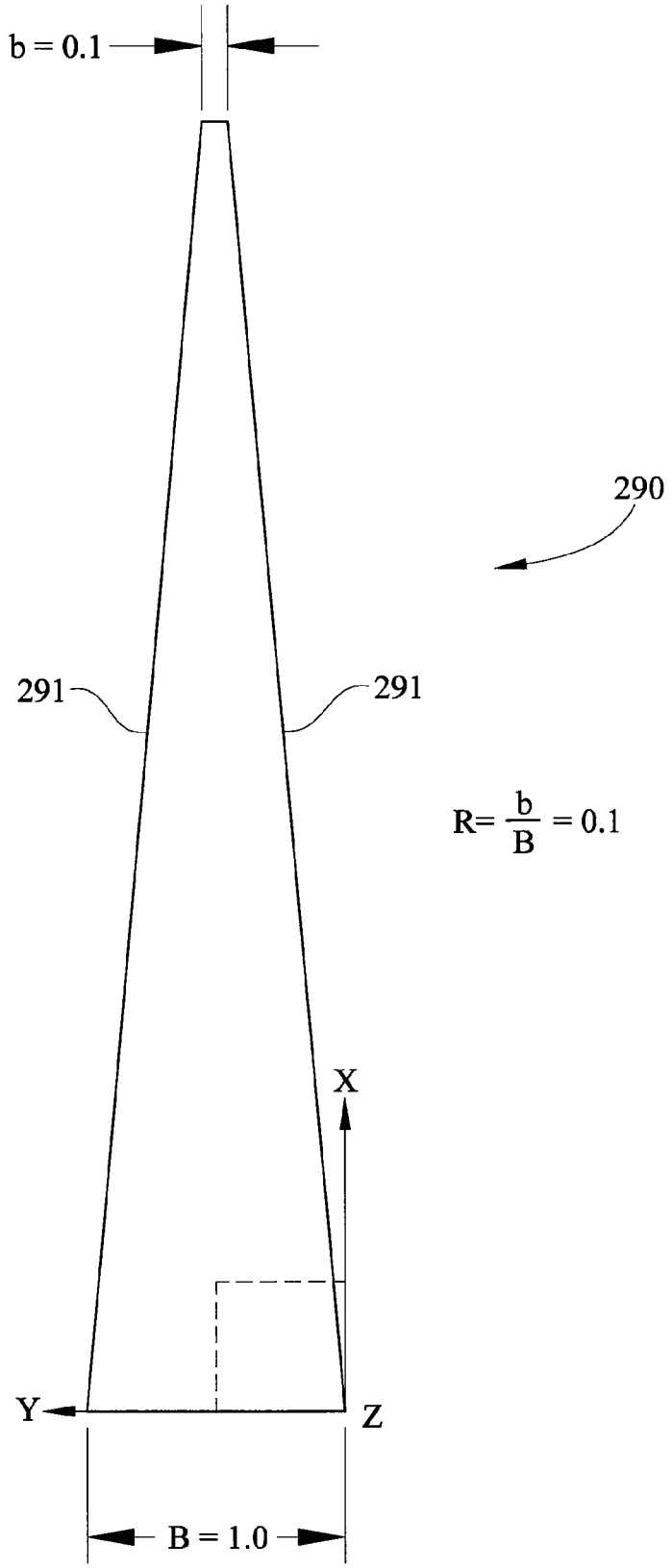
FIG. 9 depicts a front view of a representative beam having a further alternative ratio.

Referring now to FIG. 9, a further alternative beam 290 is depicted in front view as described in FIGS. 7 and 8. The beam 20 comprises a base portion having a dimension B and a tip portion having a dimension b. The tapered edges 291 extend between the base portion and tip portion of the beam 290. The beam 290 has a ratio R of b/B equal to 0.1. As previously described, upon further testing a desirable ratio of about R=0.27 was found to provide desirable characteristics for moving toner while inhibiting creep for the current cartridge architecture. As one skilled in the art will understand, such value may change with variation in cartridge design.

Figure 10:
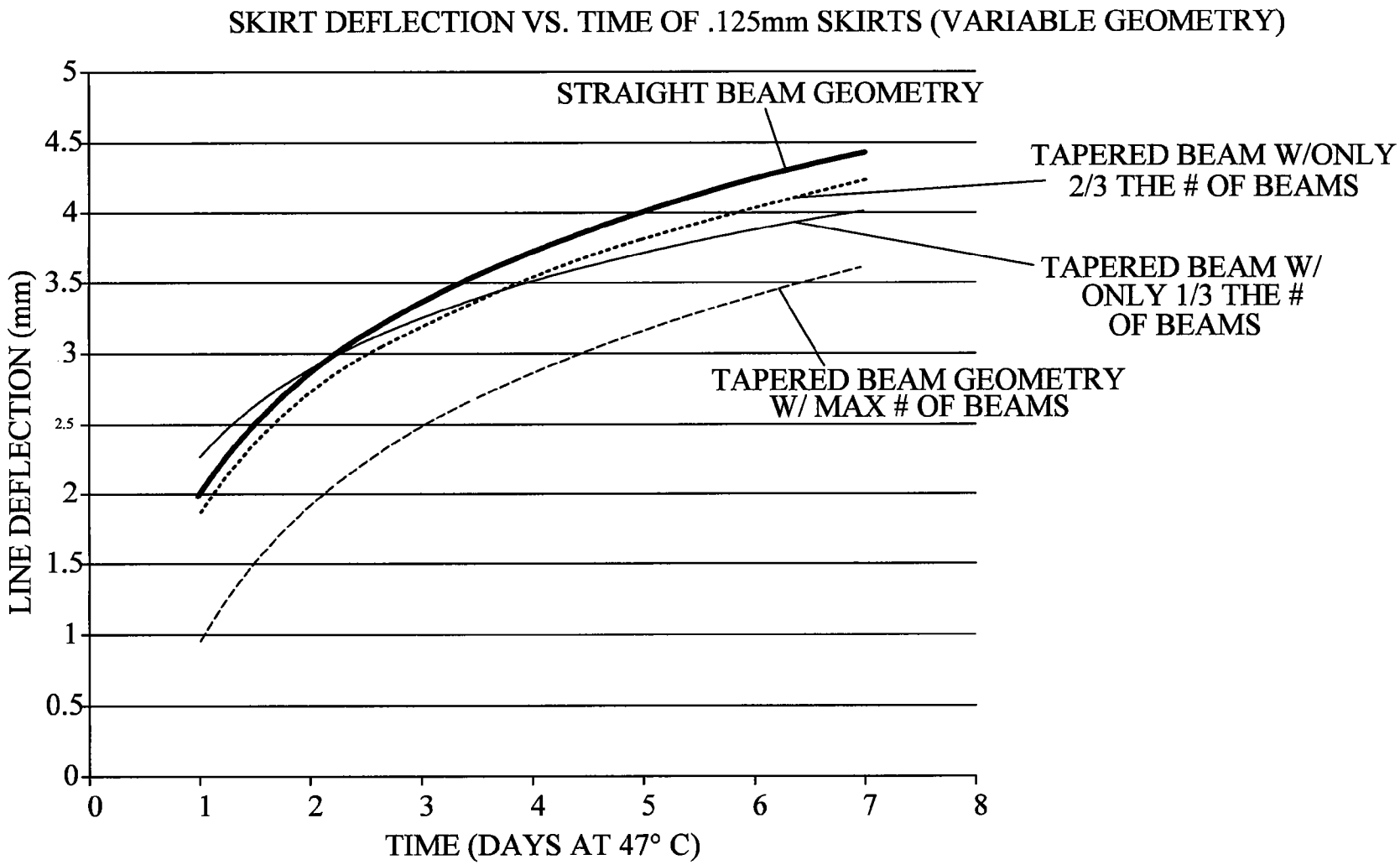
FIG. 10 depicts a first graph testing multiple skirt designs.

Referring now to FIG. 10, according to a first example, skirt deflection of a variable number of beams over a period of time at an elevated temperature in order to re-create environmental conditions during shipping. As indicated, a skirt with straight, non-tapered beams (R=1) is shown in solid line with alternative tapered beam designs shown in varying broken lines. The skirt with the least deflection utilized a greater number of tapered beams.

Figure 11:
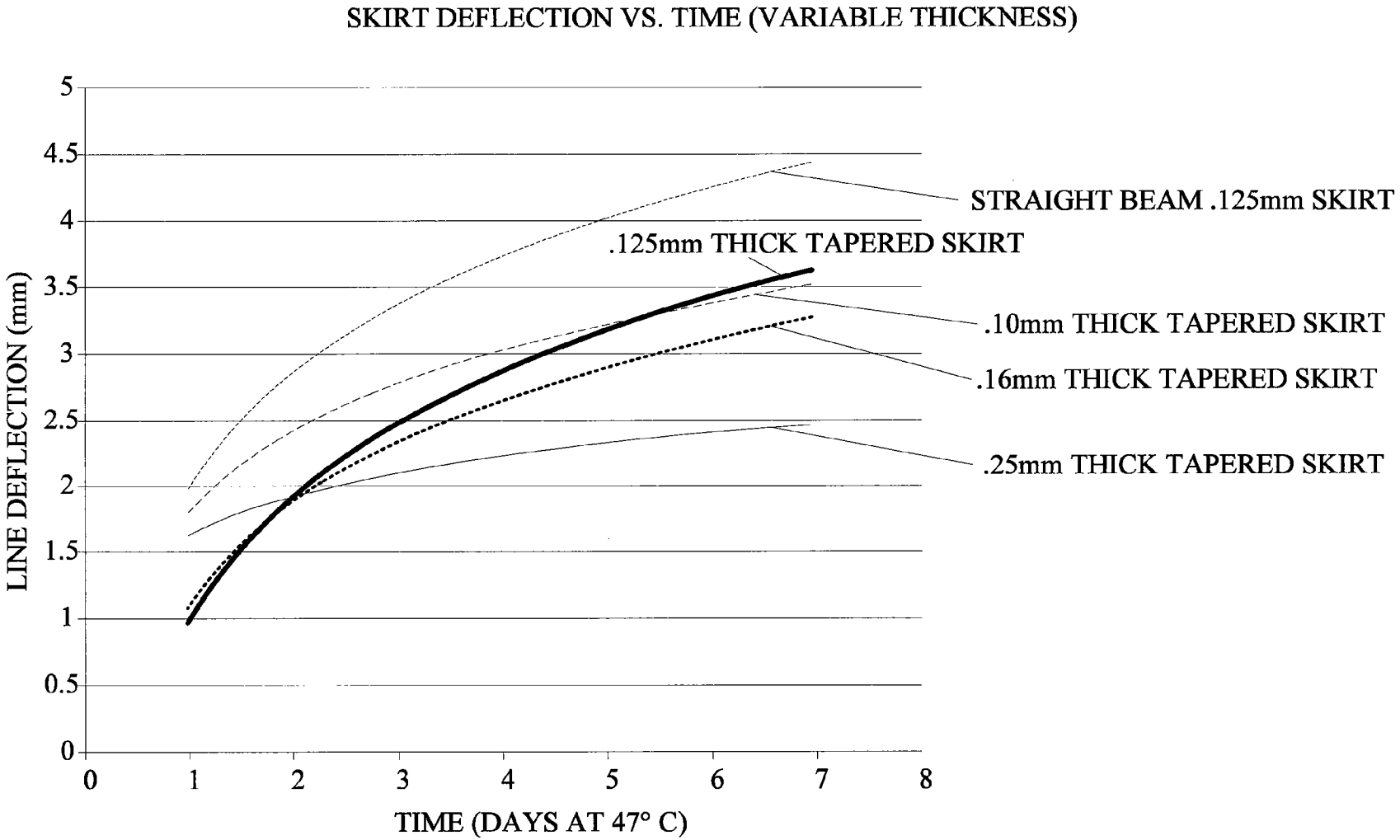
FIG. 11 depicts a second graph testing multiple skirt designs.

Referring now to FIG. 11, according to a second example, the skirt deflection was again compared during a time period at an elevated temperature. The variable characteristic was the thickness of the skirt and the relationship with the skirt deflection. As indicated in the Figure, the skirts tested included thicknesses of 0.125 millimeter, 0.1 millimeter, 0.16 millimeter and 0.25 millimeter. Additionally, one non-tapered skirt was tested in addition to a tapered skirt, which is indicated as a straight beam. Of the various thicknesses tested, the thicker tapered beam skirt performed better having the least amount of deflection of the skirts tested. Additionally, thicker skirts create larger forces for flinging toner within the cartridge. Unfortunately, however, those increased forces caused increased vibration of the cartridge, increased toner leaks, and fine line jitter due to the increased thickness of the skirt. This unexpected result led to the thinning of the skirt to an operable dimension which reduced or eliminated the vibration, toner leaks and the like while providing proper toner delivery. A range of usable skirt thicknesses for current cartridge architecture was determined to be between about 0.1 and 0.2 millimeters. Accordingly, an optimized skirt thickness of 0.10 millimeters is utilized, however, one skilled in the art should realize that with varying cartridge design, skirt dimensions may vary as well.

The foregoing description of the various embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A skirt for attachment to a shaft of a toner cartridge paddle, comprising:

a body having an upper edge, a continuous lower edge and two side edges with the upper edge and lower edge being parallel to one another;

a plurality of spaced apart tapered beams extending along said body between the upper and lower edges and attached to the upper and lower edges of the body;

each of the tapered beams having a first end dimension B adjacent the upper edge and a second end dimension b adjacent the lower edge;

each of the plurality of beams having tapered edges between the first end and the second end defining a ratio R defined by dimensions b/B being from about 0 to 0.9 for inhibiting creep deflection; and a plurality of spaced apart mounting apertures extending along the upper edge of the body for mounting the body to the shaft of the toner paddle.

2. The skirt of claim 1 wherein at least one of the plurality of mounting apertures is disposed between each of the tapered beams.

3. The skirt of claim 1 wherein said body has a thickness of about 0.1 millimeter.

4. The skirt of claim 1 wherein said body has a thickness of about 0.2 millimeters.

5. The skirt of claim 1 wherein said body is formed of polyethylene terephthalate polyester (PET).

6. The skirt of claim 1 wherein said ratio R is about 0.27.

7. A paddle assembly for urging toner to a location within a toner cartridge, comprising:

a rotatable shaft having a plurality of fasteners extending therefrom;

a skirt having a plurality of sides including an upper skirt edge and a continuous lower skirt edge and a plurality of mounting apertures therethrough and extending along said upper skirt edge for receiving corresponding ones of the plurality of fasteners for attaching said skirt to said shaft;

a plurality of spaced apart tapered beams extending between said upper skirt edge and said lower skirt edge and attached to said upper and lower skirt edges;

said tapered beams having a base portion adjacent said upper skirt edge with a dimension B and a tip portion adjacent said lower skirt edge with a dimension b; and said tapered beams being tapered from said tip portion to said base portion defining a ratio R of b to B of less than or equal to about 0.9 for inhibiting creep deflection.

8. The paddle assembly of claim 7 wherein said beams are tapered with said ratio R being about 0.27.

9. The paddle assembly of claim 7 wherein said beams have a wider dimension at an upper area and a narrower dimension at a lower area.

10. The paddle assembly of claim 7 wherein said lower skirt edge is an interference edge for engaging an inner surface of the toner cartridge.

11. The paddle assembly of claim 7, said skirt further comprising a thickness of about 0.125 millimeters.

12. The paddle assembly of claim 7, said skirt further comprising a thickness of about 0.188 millimeters.

13. The paddle assembly of claim 7, wherein said skirt has a thickness of between about 0.1 and 0.2 millimeters.

14. An attachable skirt for a toner paddle, comprising:

a flexible body having an upper edge and a continuous lower edge, the upper and lower edges being parallel, the body have a plurality of mounting apertures extending along and adjacent to the upper edge;

a plurality of windows within said body disposed between said upper edge and said lower edge of said body;

said plurality of windows defined by a plurality of tapered beams connected between said upper and lower edges of said body;

each of said plurality of tapered beams having a wider end having a dimension B near said upper edge and a narrower end having a dimension b near said lower edge; and each of said plurality of tapered beams being tapered having a ratio R of b/B of between about 0 to 0.9 to inhibit creep deflection.

* * * * *